United States Patent [19]

Yukumoto et al.

[11] Patent Number: 5,010,947

[45] Date of Patent: Apr. 30, 1991

[54] TWIN COOLING ROLL APPARATUS FOR PRODUCING RAPIDLY SOLIDIFIED METAL STRIP

[75] Inventors: Masao Yukumoto; Michiharu Ozawa; Hiroshi Yamane, all of Chiba, Japan

[73] Assignee: Kawasaki Steel Corporation, Kobe, Japan

[21] Appl. No.: 484,538

[22] Filed: Feb. 23, 1990

[30] Foreign Application Priority Data

Feb. 27, 1989 [JP] Japan ..... 1-43115

[51] Int. Cl.[5] ..... B22D 11/06

[52] U.S. Cl. ..... 164/428; 29/121.4; 29/121.6; 164/480

[58] Field of Search ..... 164/428, 480; 29/121.4, 29/121.6

[56] References Cited

U.S. PATENT DOCUMENTS

| | | | |
|---|---|---|---|
| 49,053 | 7/1865 | Bessemer | 164/428 X |
| 1,551,875 | 9/1925 | Hall | 29/121.6 X |
| 2,011,761 | 8/1935 | Handel | 29/121.4 |
| 2,530,407 | 11/1950 | Smith | 29/121.4 X |
| 3,384,730 | 5/1968 | Easley | 29/121.4 X |

*Primary Examiner*—J. Reed Batten, Jr.

*Attorney, Agent, or Firm*—Dvorak and Traub

[57] ABSTRACT

Each cooling roll has parallel grooves formed in the peripheral surface thereof so as to extend in a direction which crosses the direction of the roll axis. The grooves on one of the cooling rolls are at a phase difference from the grooves on the other cooling roll. The grooves are arranged at a pitch of 0.05 to 3.0 mm and each of the grooves has a width of 0.01 to 1.0 mm and a depth of 0.03 to 0.5 mm.

2 Claims, 7 Drawing Sheets

ROLL KISS SOLIDIFICATION COMPLETION TYPE

ROLLING TYPE

TWIN COOLING ROLL APPARATUS FOR PRODUCING RAPIDLY SOLIDIFIED METAL STRIP

BACKGROUND OF THE INVENTION

1. FIELD OF THE INVENTION

The present invention relates to a pair of cooling rolls for a twin-roll type cooling apparatus which is suitable for use in a process for forming a thin strip directly from a molten metal through rapid solidification.

2. DESCRIPTION OF THE RELATED ART

Known in the art is a pair of cooling rolls for the process for forming a metal strip directly from a molten metal, wherein the molten metal is poured from a nozzle onto the peripheral surface of a cooling roll rotating at a high speed, so as to rapidly cool and solidify the metal on the roll surface. This process is broadly sorted into two types: namely, the single-roll process which employs a single roll; and the twin-roll process which employs a pair of rolls. In general, the twin-roll process is considered to be more suitable for production of strips of a high-silicon steel, stainless steel or Inconel, from the viewpoint of quality and shape of the surface of the product strip. Studies therefore have been conducted to carry out the twin-roll process on an industrial scale to enable continuous mass-production of such strips.

One of the problems which hamper the industrial use of the single- and twin-roll processes is that various casting defects (referred to as "surface defects" hereinafter) tend to appear in the surface of the products rapidly solidified by such processes.

For instance, in the known processes mentioned above, regions of thermally inferior contact exist between the molten metal and the cooling roll so that solidification is retarded in these regions as compared with other regions, with the result that linear or island-like surface defects are caused in the portions of the product solidified at such regions. In the worst case, an irregular mosaic-like pattern of dents, i.e., so-called dimples, is formed on the product.

In order to eliminate occurrence of surface defects, Japanese Patent Laid-Open Nos. 63-501062 and 63-215340 propose a process of producing by the single roll process a crystalline metal billet having a thickness of 10 mm or less, with the roll having grooves formed in the peripheral surface of the roll so as to extend in parallel with the direction of the circumference of the roll.

On the other hand, Japanese Patent Laid-Open No. 62-254953 discloses a process for producing a metal strip of 1 to 20 mm thickness by using a cooling roll having convexities and concavities from 10 to 200 μm deep formed in the surface thereof by shot-blasting or introduction of a lattice groove.

These proposed processes ar effective in diminishing the formation of surface defects provided that factors such as the pitch and depth of the grooves formed in the roll peripheral surface ar suitably selected in accordance with the type of metal and casting conditions However, production of a thin strip of 1 mm or less thickness by a twin-roll method still suffers from a problem: namely, generation of various internal defects, as explained below.

(1) So-called shrinkage cavities or porous regions tend to be formed in the thicknesswise mid-portion of a thin strip produced by grooved rolls. The formation of such porous regions are noticeable particularly in the strip portions opposing the roll grooves.

(2) Cracks tend to be developed in the regions of the strip which have contacted the groove edges, due to solidification shrinkage of the metal in the roll grooves.

SUMMARY OF THE INVENTION

OBJECT OF THE INVENTION

Accordingly, an object of the present invention is to provide a pair of cooling rolls suitable for a cooling apparatus which is capable of producing a rapidly-solidified metal strip of a high surface quality, without causing any break-out or clinging of metal onto the roll, while suppressing the formation of surface defects on the strip, such as dimples caused by a local delay of solidification and wrinkles attributable to the flow of the molten metal in the breadthwise direction of the roll, or due to rolling, as well as internal defects such as the formation of porous regions and cracking.

BRIEF SUMMARY OF THE INVENTION

According to the present invention, there is provided a pair of cooling rolls for a twin-roll type cooling apparatus for producing a strip directly from a molten metal through rapid solidification comprising: each of said rolls having parallel grooves formed in the peripheral surface thereof so as to extend in a direction which crosses the direction of the roll axis, and said grooves on one of said cooling rolls being at a phase difference from the grooves on the other cooling roll.

The phase difference between the grooves on both rolls is most significant; it is critical to the successful operation of the process that the grooves on both cooling rolls be adjusted so as not to oppose each other.

In the production of a thin strip having a thickness of 1 mm or less, the grooves are preferably formed at a pitch of 0.05 to 3.0 mm and each the groove has a width of 0.01 to 1.0 mm and a depth of 0.03 to 0.5 mm, in order to eliminate any surface defect and internal defect while preventing break-out and twining of the strip.

Hitherto, it has been a common practice to finish the surface of a cooling roll to a surface roughness level of 0.3 μm Ra or so by means of an emery paper of #400 or equivalent. The cooling roll surface thus finished still tends to cause surface defects when the molten metal such as aluminum, copper, silicon steel, stainless steel or Inconel is rolled and solidified on the thus finished cooling roll surface. Such defects are often visible by naked eyes, and they appear in the form of islands, lines, mosaic dimples or cracks on the surface of the strip. For Instance, as will be seen from FIGS. 6(*a*) to 6(*c*) which show the states of solidification of the molten metal 6 contacting the surface of the flat roll as observed at moments $t_1$ to $t_3$ in FIG. 5, a region 12 of inferior cooling, marked by x, existing on the roll surface causes generation of a local delay of solidification as at 13 as shown in FIG. 6(*b*), resulting in generation of a porous region 14 as shown in FIG. 6(*c*). In FIG. 5, numeral 8 denotes a liquid phase region, 9 denotes a solid/liquid phase region, 10 denotes solid phase region and 11 denotes a gas or an oxide film.

Provision of grooves in the peripheral surface of a cooling roll brings about the following advantages. Ridges and recesses presented by the grooves serve to constrain the solidification layer of the metal on the roll surface, so that the contraction of the solidified layer due to temperature drop takes place in accordance with the ridges and recesses, thus eliminating any local concentration of contraction of the strip and, hence, production of surface defects. In the production of a thin strip having a thickness of 1 mm or less, the solidification of the molten metal is usually completed while the molten metal is in the region of minimum gap (referred to as "roll kiss portion", hereinafter) between the opposing cooling rolls, as shown in FIG. 7(*a*). On the other hand, production of a comparatively thick strip having thicknesses of 1 mm or greater is of rolled solidification type in which the point at which the molten metal is solidified is located above the roll kiss point as shown in FIG. 7(*b*).

The roll kiss solidification completion type method for producing strips of 1 mm thick or thinner often suffers from production of porous regions or unsolidified layer in the thicknesswise mid portion of the cast strip, due to thermal contraction of the solidified layer, particularly non-uniform deformation of the solidified layer at the free surface opposite to the roll surface, not to mention the production of surface defects. It is true that the use of a grooved cooling roll appreciably reduces surface defects by virtue of promotion of uniform solidification brought about by the grooves. However, thermal contraction of the portions of the solidified layer in the grooves 4 produces porous regions 14 as shown in FIG 8(*c*) in the portions of the strip which have contacted the bottoms of the grooves 4 when the casting is completed, as will be seen from FIGS. 8(*a*) to (*c*) which show states of solidification of the molten metal 6 contacting the surface of the grooved roll 1, with the result that cracks 16 develop in the strip from the portions of the strip which have contacted the edges of the grooves 4.

Grooving of the roll surface alone is insufficient for eliminating the above-mentioned problem peculiar in the production of a thin strip having a thickness of 1 mm or less. It is necessary that the grooves formed on the surfaces of both cooling rolls do not oppose each other, i.e., that a certain phase difference is formed between the grooves in the surface of one of the rolls and those in the surface of the other roll.

In order to avoid the production of surface and internal defects, it is necessary that the factors such as the pitch, depth and width of the grooves are fully discussed and carefully selected. It is necessary that the groove width should range between 0.01 and 1.0 mm, that the depth should range between 0.03 and 0.5 mm and that the pitch should range between 0.05 and 3.0 mm.

When the width is smaller than 0.01 mm while the depth is below 0.03 mm, the molten metal cannot fill the grooves because the surface tension of the molten meta is greater than the hydrostatic pressure of the metal, so that solidification nuclides cannot be formed. In such a case, therefore, the solidification proceeds in a non-uniform manner, allowing the production of surface defects and internal defects such as porous regions and cracking due to non-uniform solidification, as in the case of the production of strips with a conventional flat roll. This tendency is noticeable particularly in the roll kiss solidification completion type process applied to production of thin strips of 1 mm thick or thinner.

A groove pitch exceeding 3.0 mm causes an increase in the area of the smooth portions on the roll surface, causing non-uniform solidification of the metal between adjacent grooves, thus hampering uniform solidification over the entire portion of the strip.

When the groove width and the depth respectively exceed 1.0 mm and 0.5 mm, or when the pitch is reduced below 0.05 mm, the molten metal penetrates too deeply into the roll surface so that a scorching of the surface of the strip, after solidification, tends to occur, causing various troubles such as separation due to twining of the metal on both rolls, break-out or twining of the solidified strip on one of the rolls.

The above and other objects, features and advantages of the present invention will become clear form the following description of the preferred embodiments when the same is read in conjunction with the accompanying drawings.

BRIEF DESCRIPTION OF THE DRAWINGS

FIG. 1(*b*) is a sectional view showing a surface layer of the cooling roll;

DESCRIPTION OF THE PREFERRED EMBODIMENTS

Figure 1:
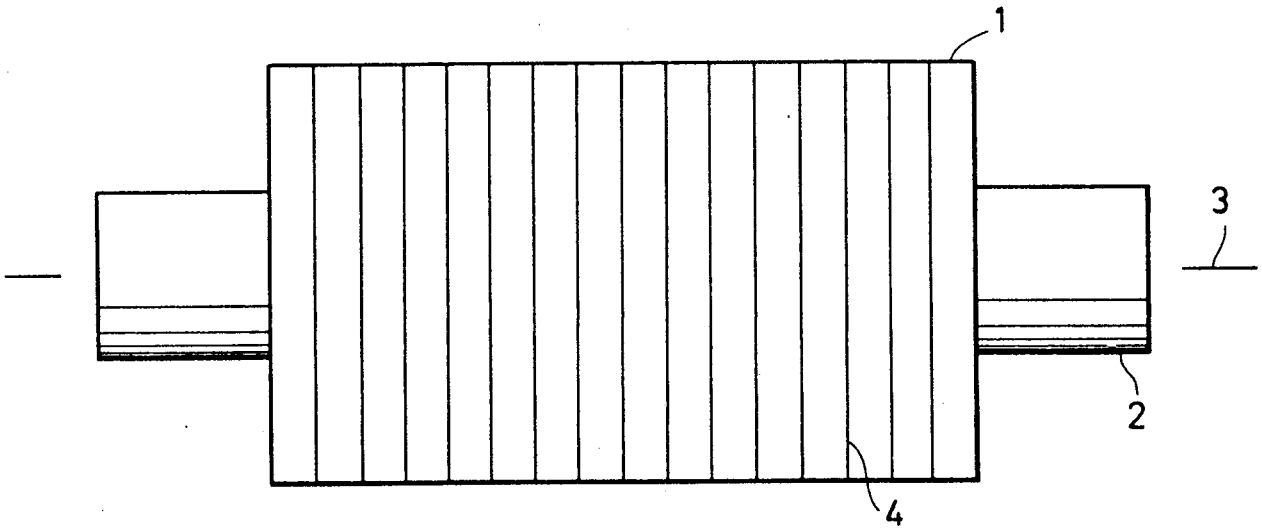
FIG. 1(*a*) is a front elevational view of a cooling roll.
Figure 1:
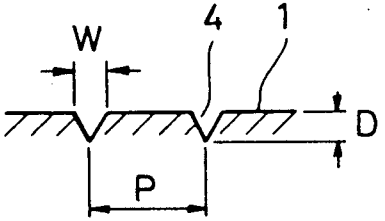

One of the cooling rolls of the preferred embodiment of the invention is shown in FIG. 1(*a*).

Figure 2:
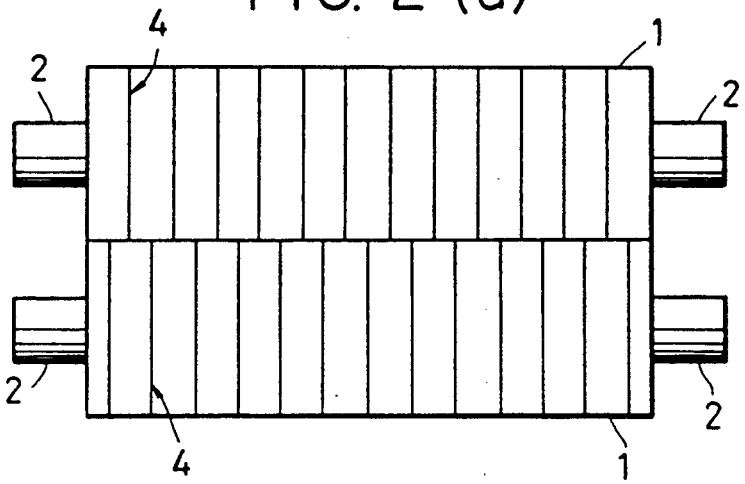
FIGS. 2(*a*) to 2(*c*) are plan views of the cooling roll apparatus showing the patterns of grooves on cooling rolls.
Figure 2:
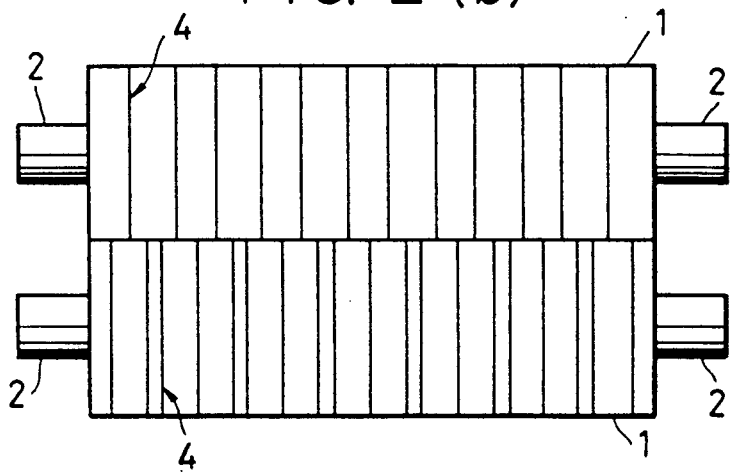
Figure 2:
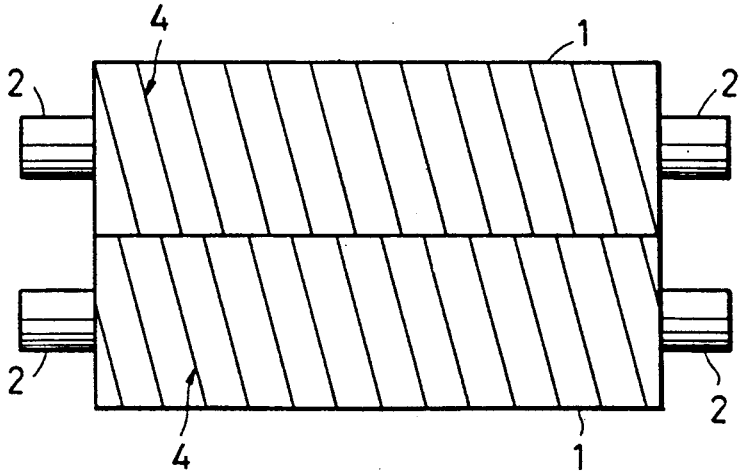
Figure 3:
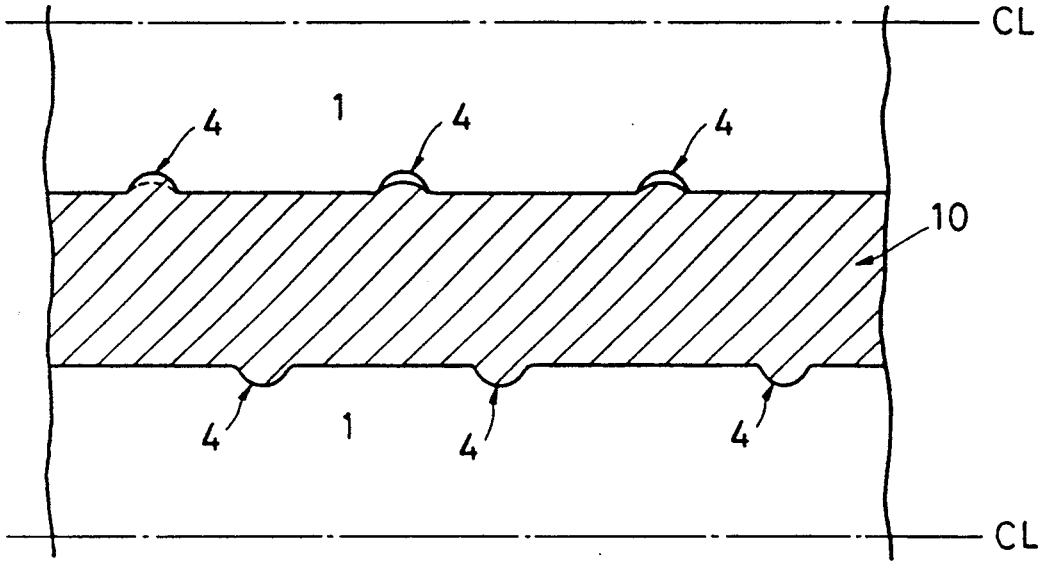
FIG. 3 is a sectional view of a metal strip which is being rapidly cooled in a roll kiss portion between two rolls of a twin roll as viewed from the upper side of the twin roll.

The roll has a roll barrel 1 made of copper or a copper alloy having superior heat conductivity and a roll shaft 2. The roll has a plurality of parallel grooves 4 formed in the surface of the roll barrel 1 so as to extend in a direction perpendicular to the axis 3 of the roll. As will be seen from FIG. 1(*b*), each groove 4 has a V-shaped sectional shape in this embodiment. The width W, depth D and the pitch P of the grooves 4 are determined to fall within the ranges described before. The groove 4 can have any other suitable sectional shape, such as U-like form. FIGS. 2(*a*) to 2(*c*) show examples of arrangement of the grooves on opposing rolls 1 in the cooling roll apparatus of the present invention. The grooves may be arranged in accordance with one of these examples or in other suitable manners, provided that the grooves on the obverse and reverse sides of the strip 10 after the solidification do not align with each other in the direction of axis of the roll, i.e., that the grooves 4 formed on both rolls do not confront each other as shown in FIG. 3.

The grooves are formed preferably by, for example, knurling, machining such as cutting by a lathe or a slotter, photo-etching, electric discharge or laser beam processing. It is also preferred that a brush wiper is applied to clean the inside of the grooves.

EXAMPLES

Figure 4:
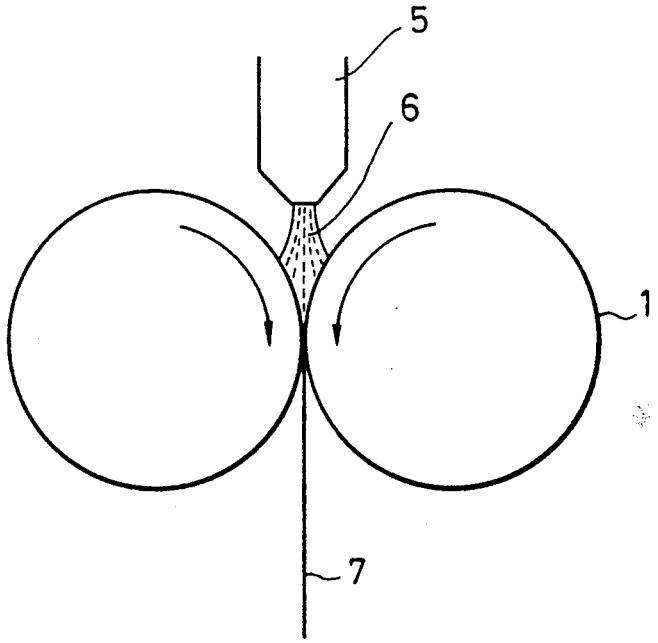
FIG. 4 is a schematic illustration of a twin-roll type cooling apparatus for producing a rapidly-solidified strip.
Figure 5:
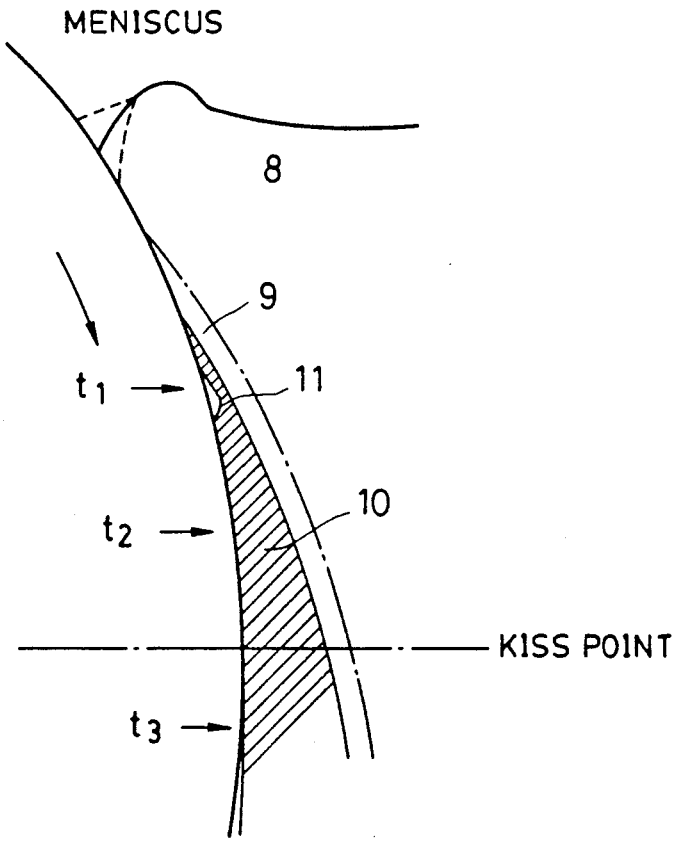
FIG. 5 is a schematic illustration of the manner of solidification of the molten metal taking place on the roll surface.
Figure 6:
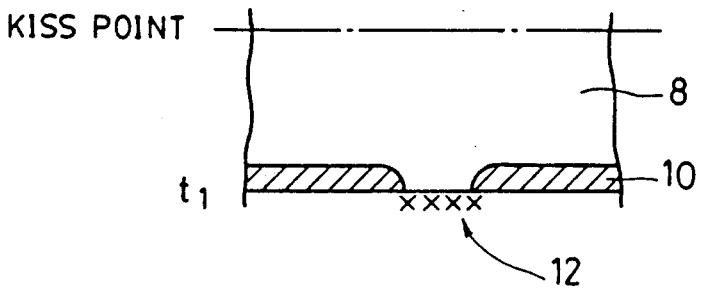
FIGS. 6(*a*) to 6(*c*) are schematic illustrations showing states of solidification of the molten metal on a flat roll at moments $t_1$ to $t_3$ shown in FIG. 5, respectively.
Figure 6:
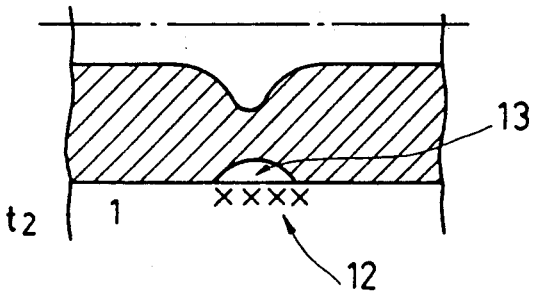
Figure 6:
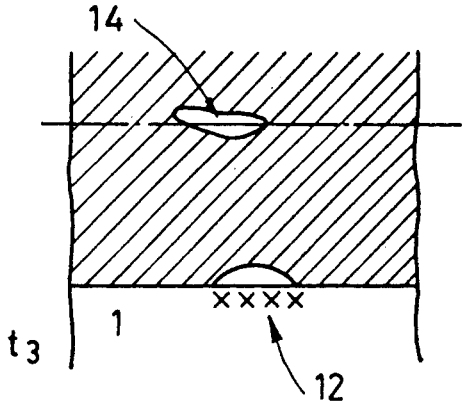
Figure 7:
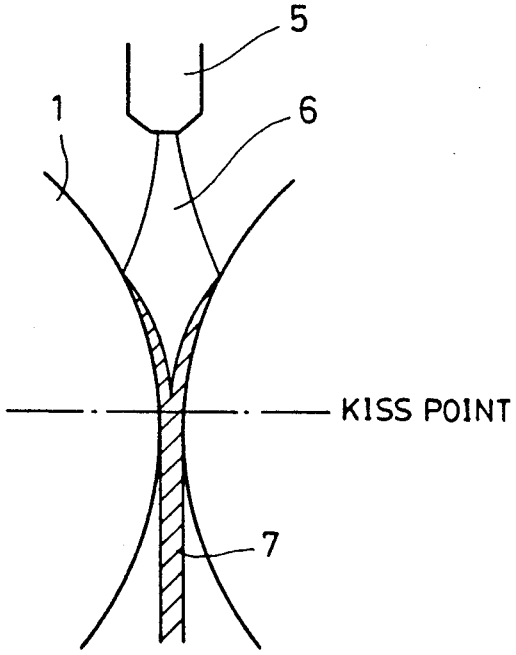
FIGS. 7(*a*) and 7(*b*) are illustrations of a solidification model of a twin-roll process.
Figure 7:
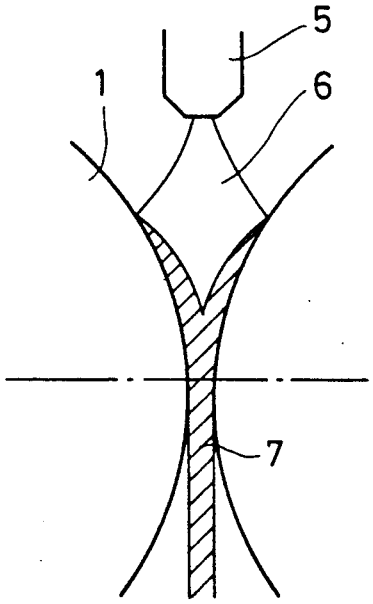
Figure 8:
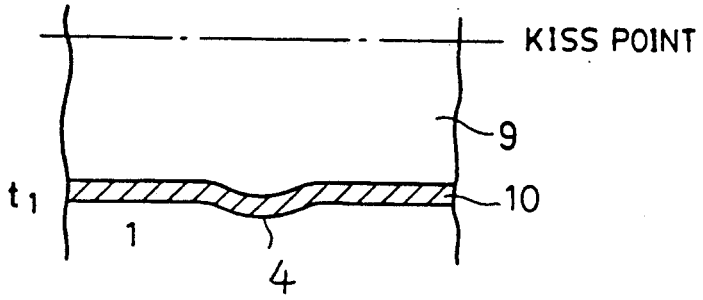
FIGS. 8(*a*) to 8(*c*) are schematic illustrations showing states of solidification of the molten metal on a grooved roll at moments $t_1$ to $t_3$ shown in FIG. 5, respectively.
Figure 8:
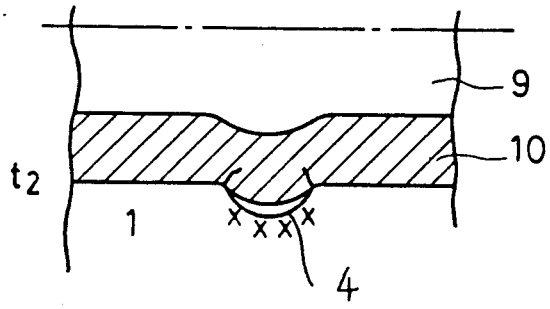
Figure 8:
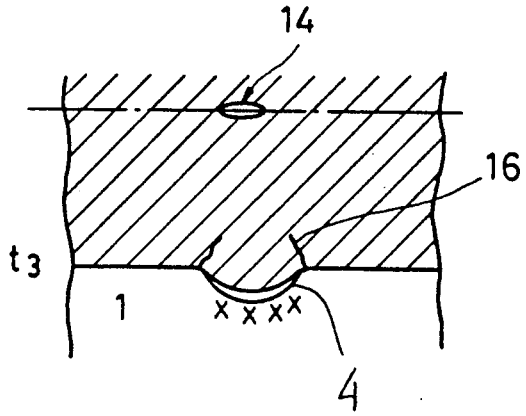

Strips were produced by applying various cooling rolls to the twin roll type apparatus of FIG. 4 for producing rapidly-solidified strips. In FIG. 4, numerals 5 denotes a nozzle for supplying a molten metal 6, while 7 designates a strip.

More specifically, rapidly-solidified strips of 400 mm wide and 0.5 mm thick were produced from a material Inconel 600 (76 wt%Ni-15wt%Cr-0.8wt%Mn 0.5wt%Si-7.0wt%Fe) by the apparatus shown in FIG. 4 while employing a variety of cooling rolls of the specifications shown in Table 1. Results of examination of the surface states of the thus produced strips are also shown in Table 1. The casting was conducted at a roll peripheral speed of 2.1 m/sec., rolling load of 1 ton and pouring temperature of 1650° C.

As will be seen from the table, the strips produced with the cooling rolls Nos. 1 to 10 did not show any surface defects and internal defects, e.g., porous regions and cracks, while the strips produced by cooling rolls Nos. 19 to 22 having flat roll surfaces showed surface defects. Cooling rolls Nos. 11 to 18 has surface grooves or convexities and concavities, but such grooves or convexities and concavities did not meet the requirements of the present invention. When such rolls were used, surface defects and internal defects were observed in the product strips or the casting could not be carried out due to occurrence of twining or break-out.

As will be understood from the foregoing description, the twin-roll type apparatus employing cooling rolls of the invention enables production of rapidly-solidified strips without any surface defects and internal defects, and without suffering from troubles such as twining or break-out of the strip, thus making it possible to industrially carry out continuous mass-production of high-strength metal strips by utilizing rapid cooling effect of the cooling rolls.

TABLE 1

| No. | Shape of groove in roll surface | Spec. of groove (mm) Width | Depth | Pitch | Groove phase difference | Roll materials | States of surfaces of strips | Remarks |
|---|---|---|---|---|---|---|---|---|
| 1 | Parallel *1 | 0.5 | 0.1 | 1.5 | Exists | Copper alloy | No surface defect and no porous region | Examples of Invention |
| 2 | " | 0.01 | 0.03 | 0.05 | " | " | No surface defect and no porous region | |
| 3 | " | 1.0 | 0.5 | 3.0 | " | Stainless steel | No surface defect and no porous region | |
| 4 | " | 0.8 | 0.07 | 2.0 | " | Copper | No surface defect and no porous region | |
| 5 | Slant *2 | 0.01 | 0.5 | 0.05 | " | " | No surface defect and no porous region | |
| 6 | " | 1.0 | 0.1 | 1.0 | " | Stainless steel | No surface defect and no porous region | |
| 7 | Parallel *1 | 0.05<br>0.2 | 0.1<br>0.05 | 1.5<br>3.0 | " | " | No surface defect and no porous region | |
| 8 | " | 1.5 | 0.1 | 3.0 | " | Copper | No surface defect, no exists porous region, twining | |
| 9 | " | 1.0 | 0.7 | 1.5 | " | " | No surface defect, no exists porous region, twining | |
| 10 | Slant *2 | 1.0 | 0.7 | 2.0 | " | Copper alloy | No surface defect, no exists porous region, twining | |
| 11 | Lattice | 0.1 | 0.5 | 1.0 | Does not exist | Copper | Scorch of strip, break-out | Comparison Examples |
| 12 | Parallel *1 | 0.5 | 0.1 | 1.5 | Does not exist | Copper alloy | Fine surface cracks and porous regions | |
| 13 | Slant *2 | 1.0 | 0.1 | 1.0 | Does not exist | " | Fine surface cracks and porous regions | |
| 14 | Parallel *1 | 1.0 | 0.5 | 3.0 | Does not exist | Copper alloy | Fine surface cracks and porous regions | |
| 15 | " | 0.8 | 0.07 | 2.0 | Does not exist | Stainless steel | Fine surface cracks and porous regions | |
| 16 | " | 0.5<br>0.3 | 0.1<br>0.2 | 1.0<br>2.0 | Does not exist | " | Fine surface cracks and porous regions | |
| 17 | Lattice | 0.2<br>0.1 | 0.1<br>0.2 | 2.0<br>3.0 | Does not exist | Copper | Fine surface cracks and porous regions | |
| 18 | Shot-blast | 0.1 | 0.2 | — | Does not exist | " | Mosaic-like defect, cracks found | |
| 19 | Flat | — | — | — | — | " | Mosaic-like defect, cracks found | |
| 20 | " | — | — | — | — | Cr-plated | Mosaic-like defect, cracks found | |
| 21 | " | — | — | — | — | S45C | Mosaic-like defect, cracks found | |
| 22 | " | — | — | — | — | WC flame-sprayed | Mosaic-like defect, cracks found | |

*1 Refer to FIG. 2(a)
*2 Refer to FIG. 2(c)

What is claimed is:

1. A twin cooling-roll continuous casting apparatus for producing a single metal strip, having a thickness of 1 mm. or less, directly from a molten metal through rapid solidification wherein each of said cooling rolls: has parallel grooves formed in the peripheral surface thereof so as to extend in a direction which crosses the direction of the roll axis, and said grooves on one of said cooling rolls are at a phase difference from the grooves on the other cooling rolls.

2. The twin cooling-roll continuous casting apparatus according to claim 1, wherein said grooves are arranged at a pitch of 0.05 to 3.0 mm and each said groove has a width of 0.01 to 1.0 mm and a depth of 0.03 to 0.5 mm.

* * * * *